US006037871A

United States Patent [19]

Babylon

[11] Patent Number: 6,037,871

[45] Date of Patent: Mar. 14, 2000

[54] BATHROOM HYGIENE TRAINING SYSTEM

[76] Inventor: Stephen K. Babylon, 438 S. Main St. #3, Piqua, Ohio 45356

[21] Appl. No.: 09/368,693

[22] Filed: Aug. 5, 1999

[51] Int. Cl.[7] ..... G08B 23/00

[52] U.S. Cl. ..... 340/573.1; 340/667; 340/693.5; 4/902

[58] Field of Search ..... 340/573.1, 603, 340/540, 665–667, 693.5, 693.9, 692; 4/902, 661; 434/236, 262

[56] References Cited

U.S. PATENT DOCUMENTS

| | | | |
|---|---|---|---|
| 4,849,742 | 7/1989 | Warrington | 340/686 |
| 4,883,749 | 11/1989 | Roberts et al. | 434/247 |
| 5,384,917 | 1/1995 | Epling | 4/235 |
| 5,573,407 | 11/1996 | Dunford | 434/262 |
| 5,748,096 | 5/1998 | Kaufer | 340/686 |
| 5,870,015 | 2/1999 | Hinkel | 340/573.1 |
| 5,890,242 | 4/1999 | Minter | 4/661 |
| 5,945,914 | 8/1999 | Holmes et al. | 340/667 |
| 5,952,924 | 9/1999 | Evans et al. | 340/573.1 |

*Primary Examiner*—Jeffery A. Hofsass
*Assistant Examiner*—Sihong Huang

[57] ABSTRACT

A bathroom hygiene training system for teaching of proper bathroom hygiene to a child. The bathroom hygiene training system includes a toilet. A toilet sensing housing is removably coupled to the tank. A toilet sound play back assembly is orientated within the toilet sensing housing. A seat sensor is coupled to the toilet sensing housing. A handle sensor is coupled to the toilet sensing housing. A step stool having a platform and a plurality of legs. A step stool sound play back assembly is orientated within the platform of the step stool. A sensor pad is coupled to the platform of the step stool. A sink having a counter top, a washbasin and a pedestal. A soap dish sensing housing is for resting upon the countertop proximate the washbasin. A soap dish sound play back assembly is orientated within the soap dish sensing housing. A soap dish sensor is coupled to the soap dish sensing housing.

5 Claims, 3 Drawing Sheets

BATHROOM HYGIENE TRAINING SYSTEM

BACKGROUND OF THE INVENTION

1. Field of the Invention

The present invention relates to toilet training devices and more particularly pertains to a new bathroom hygiene training system for teaching of proper bathroom hygiene to a child.

2. Description of the Prior Art

The use of toilet training devices is known in the prior art. More specifically, toilet training devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,008,964; U.S. Pat. No. 3,870,318; U.S. Pat. No. 4,288,789; U.S. Pat. No. 4,162,490; U.S. Pat. No. 3,191,193; and U.S. Pat. No. Des. 382,360.

In these respects, the bathroom hygiene training system according to the present invention substantially departs from the conventional concepts and designs of the prior art, and in so doing provides an apparatus primarily developed for the purpose of teaching of proper bathroom hygiene to a child.

SUMMARY OF THE INVENTION

In view of the foregoing disadvantages inherent in the known types of toilet training devices now present in the prior art, the present invention provides a new bathroom hygiene training system construction wherein the same can be utilized for teaching of proper bathroom hygiene to a child.

The general purpose of the present invention, which will be described subsequently in greater detail, is to provide a new bathroom hygiene training system apparatus and method which has many of the advantages of the toilet training devices mentioned heretofore and many novel features that result in a new bathroom hygiene training system which is not anticipated, rendered obvious, suggested, or even implied by any of the prior art toilet training devices, either alone or in any combination thereof.

To attain this, the present invention generally comprises a toilet. A toilet sensing housing is removably coupled to the tank. A toilet sound play back assembly is orientated within the toilet sensing housing. A seat sensor is coupled to the toilet sensing housing. A handle sensor is coupled to the toilet sensing housing. A step stool having a platform and a plurality of legs. A step stool sound play back assembly is orientated within the platform of the step stool. A sensor pad is coupled to the platform of the step stool. A sink having a counter top, a washbasin and a pedestal. A soap dish sensing housing is for resting upon the countertop proximate the washbasin. A soap dish sound play back assembly is orientated within the soap dish sensing housing. A soap dish sensor is coupled to the soap dish sensing housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bathroom hygiene training system apparatus and method which has many of the advantages of the toilet training devices mentioned heretofore and many novel features that result in a new bathroom hygiene training system which is not anticipated, rendered obvious, suggested, or even implied by any of the prior art toilet training devices, either alone or in any combination thereof.

It is another object of the present invention to provide a new bathroom hygiene training system which may be easily and efficiently manufactured and marketed.

It is a further object of the present invention to provide a new bathroom hygiene training system which is of a durable and reliable construction.

An even further object of the present invention is to provide a new bathroom hygiene training system which is susceptible of a low cost of manufacture with regard to both materials and labor, and which accordingly is then susceptible of low prices of sale to the consuming public, thereby making such bathroom hygiene training system economically available to the buying public.

Still yet another object of the present invention is to provide a new bathroom hygiene training system which provides in the apparatuses and methods of the prior art some of the advantages thereof, while simultaneously overcoming some of the disadvantages normally associated therewith.

Still another object of the present invention is to provide a new bathroom hygiene training system for teaching of proper bathroom hygiene to a child.

Still yet another object of the present invention is to provide a new bathroom hygiene training system that will encourage children to use the bathroom.

Even still another object of the present invention is to provide a new bathroom hygiene training system that will help prevent illness in children through encouraging cleanliness.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
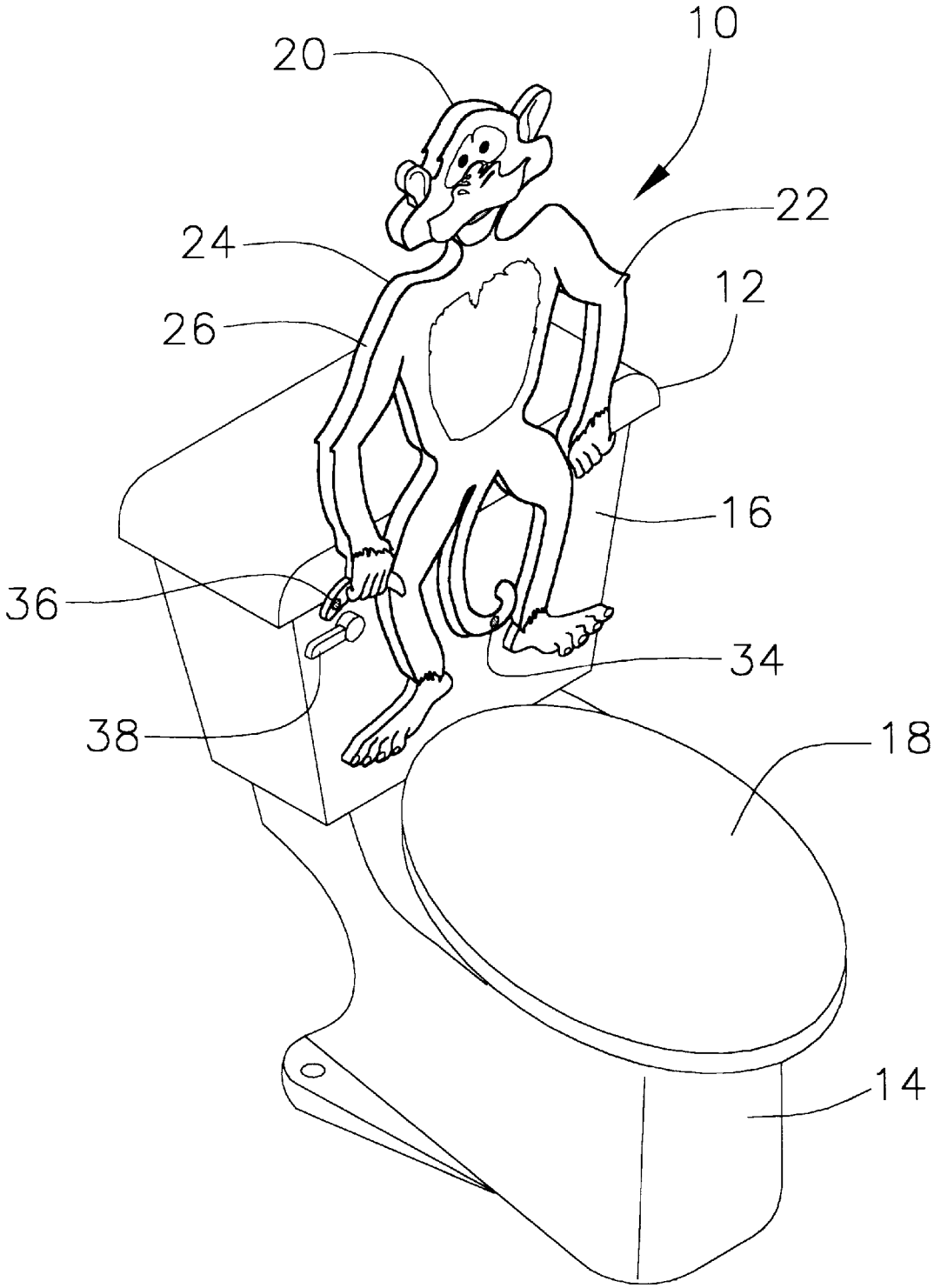
FIG. 1 is a perspective view of the toilet portion of a new bathroom hygiene training system according to the present invention.
Figure 2:
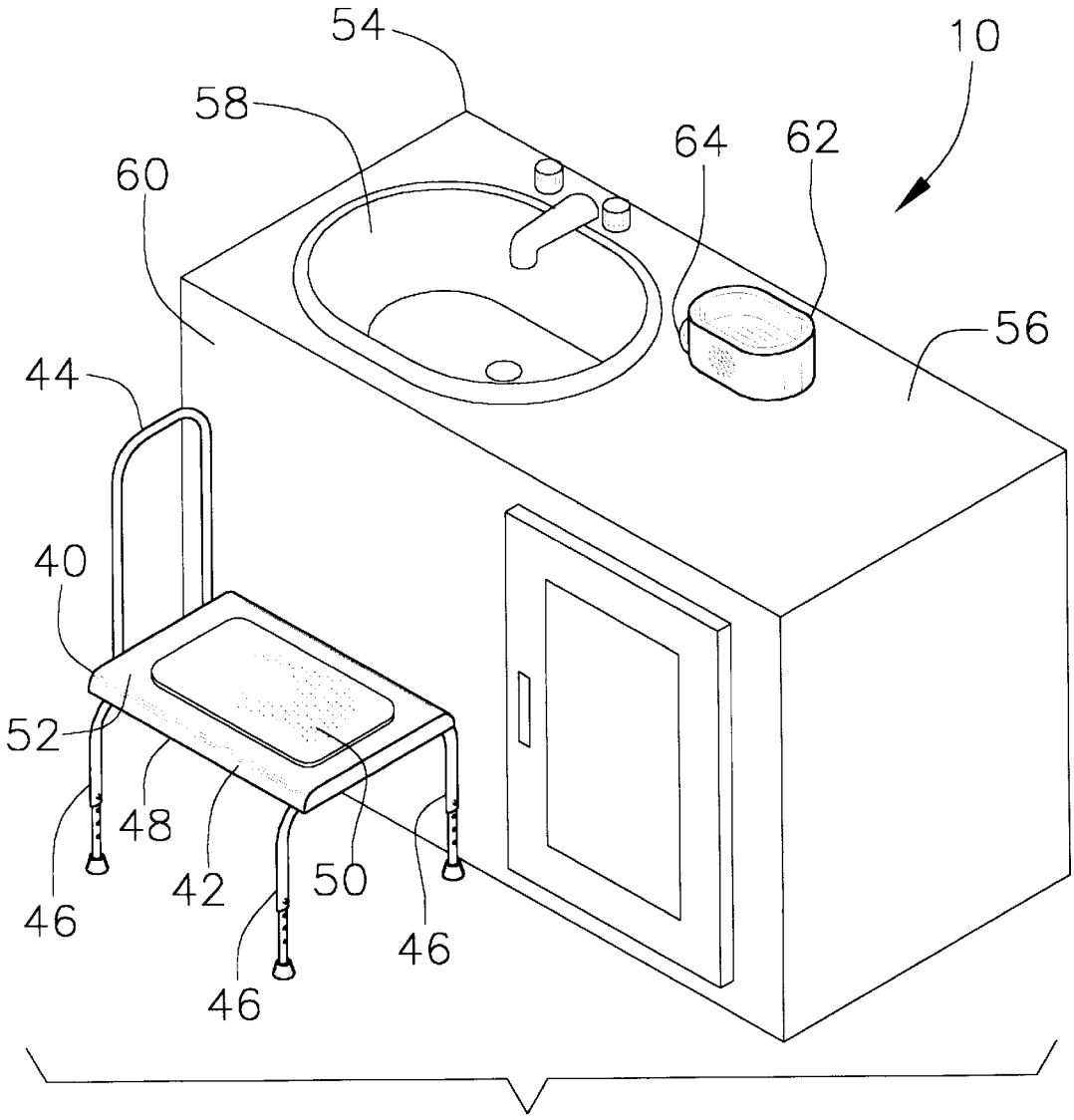
FIG. 2 is a perspective view of the sink portion of the present invention.
Figure 3:
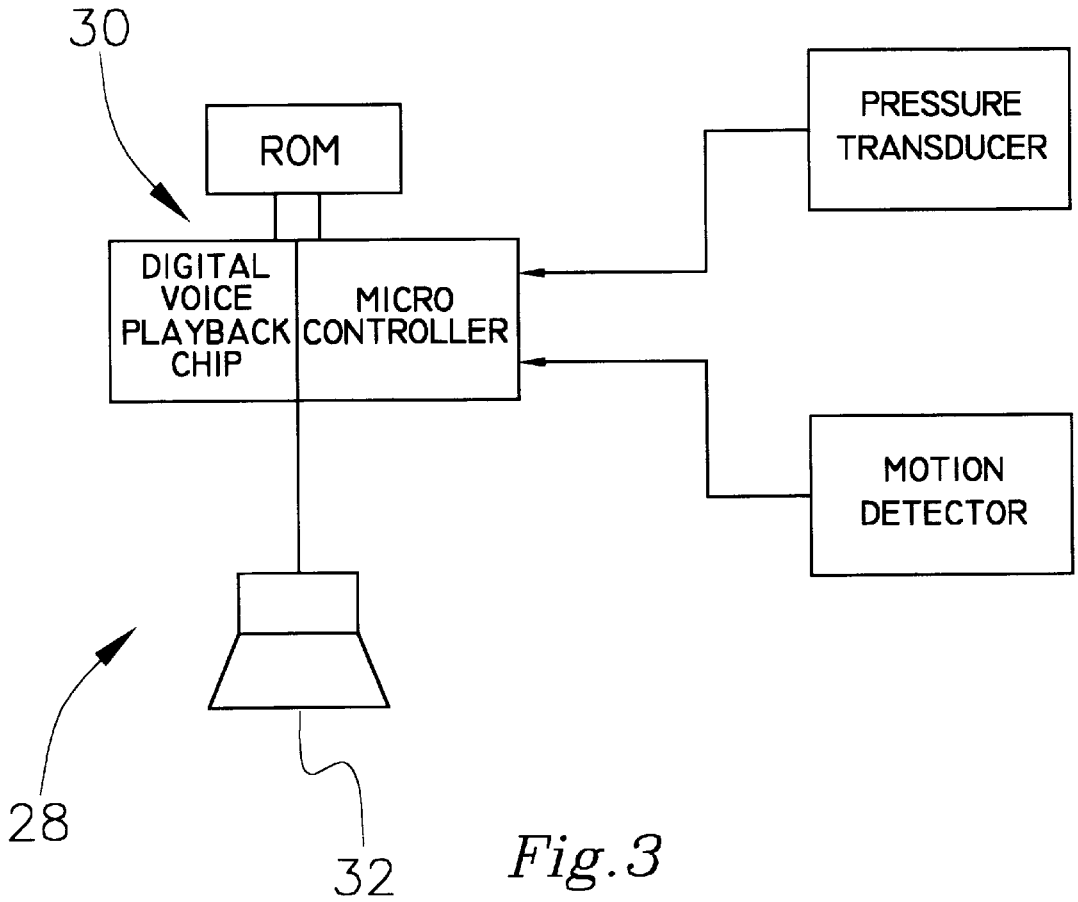
FIG. 3 is a schematic view of the sound playback assembly of the present invention.

With reference now to the drawings, and in particular to FIGS. 1 through 3 thereof, a new bathroom hygiene training system embodying the principles and concepts of the present invention and generally designated by the reference numeral 10 will be described. As best illustrated in FIGS. 1 through 3, the bathroom hygiene training system 10 generally comprises a toilet 12 having a bowl 14, a tank 16 and a seat 18.

As shown in FIG. 1 a toilet sensing housing 20 is removably coupled to the tank. The toilet sensing housing is generally shaped like a monkey such that the toilet sensing housing provides a pleasing character for a child to relate to. The housing has a front face 22, a rear face 24 and a perimeter wall 26. The perimeter wall is extended between a perimeter of the front face and a perimeter of the rear face.

A toilet sound play back assembly 28 is orientated within the toilet sensing housing. The toilet sound play back assembly has a digital playback controller 30 and a speaker 32. The speaker is for playing back prerecorded messages stored by the digital playback controller upon the activation of the digital playback controller.

Also included is a seat sensor 34 for detecting motion, the seat sensor is coupled to the toilet sensing housing such that when the seat is raised the seat sensor is covered. The seat sensor is for sending a seat raised activation signal to the playback controller when the seat is raised.

Next provided is a handle sensor 36 coupled to the toilet sensing housing proximate a flushing handle 38 of the tank. The handle sensor is for detecting movement of the handle and sending a handle activation signal to the playback controller upon detecting movement of the handle.

As shown in FIG. 2 a step stool 40 has a platform 42, a handrail 44 and a plurality of adjustable legs 46. A step stool sound playback assembly is orientated within the platform of the step stool. The hand rail is couple to an end of the step stool. The adjustable legs extend downward from a bottom surface 48 of the platform. The step stool playback assembly has components equivalent to the toilet sound play back assembly.

A sensor pad 50 is coupled to an upper surface 52 of the platform of the step stool. The sensor pad is adapted for detecting pressure changes due to the child stepping onto the sensor pad. The sensor pad is for sending a sensor pad activation signal to the step stool play back assembly upon detecting pressure change.

As shown in FIG. 2, a sink 54 has a counter top 56, a washbasin 58 and a pedestal 60. A soap dish sensing housing 62 is for resting upon the countertop proximate the washbasin. A soap dish sound play back assembly is orientated within the soap dish sensing housing. The soap dish playback assembly has components equivalent to the toilet sound play back assembly.

A soap dish sensor 64 is coupled to the soap dish sensing housing. The soap dish sensor is for detecting movement in an area proximate the soap dish housing and sending a soap activation signal to the soap dish sound play back assembly upon detecting movement.

In use, the system would be placed in a bathroom commonly used by a child. The toilet sensing housing would be placed on a toilet tank. When the child would raise the seat a friendly reminder and praise would be produced via the speaker. The child when child would then flush the toilet by depressing the handle of the toilet. Upon the child's hand moving near the handle a praise for flushing and a reminder to wash would be produced via the speaker. The child would the proceed to the step stool where he would step on the sensor pad and friendly reminder and praise would be produced via speaker in the step stool. As the child would reach for the soap the sensor in a soap dish would provided a friendly reminder and praise for the child via a speaker in the soap dish. Then as the child would replace the soap in the soap dish a final friendly praise and reminder would be produced.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bathroom hygiene training system comprising:

a toilet having a bowl, a tank and a seat;

a toilet sensing housing being removably coupled to said tank;

a toilet sound play back assembly being orientated within said toilet sensing housing, said toilet sound play back assembly having a digital playback controller and a speaker, said speaker being for playing back prerecorded messages stored by said digital playback controller upon the activation of said digital playback controller;

a seat sensor being coupled to said toilet sensing housing, said seat sensor being for sending a seat raised activation signal to said playback controller upon the detection of movement;

a handle sensor being coupled to said toilet sensing housing proximate a flushing handle of said tank, said handle sensor being for detecting movement of said handle and sending a handle activation signal to said playback controller upon detecting movement of said handle;

a step stool having a platform and a plurality of legs, a step stool sound play back assembly being orientated within said platform of said step stool, said legs extending downward from said platform;

a sensor pad being coupled to said platform of said step stool, said sensor pad being adapted for detecting pressure changes, said sensor pad being for sending a sensor pad activation signal to said step stool play back assembly upon detecting pressure change;

a sink having a counter top, a washbasin and a pedestal;

a soap dish sensing housing being for resting upon the countertop proximate the washbasin, a soap dish sound play back assembly being orientated within said soap dish sensing housing; and a soap dish sensor being coupled to said soap dish sensing housing, said soap dish sensor being for detecting movement in an area proximate said soap dish housing and sending a soap activation signal to said soap dish sound play back assembly upon detecting movement.

2. The bathroom hygiene training system as set forth in claim 1 wherein said toilet sensing housing is generally shaped like an animal.

3. The bathroom hygiene training system as set forth in claim 1 wherein said toilet sensing housing has indicia indicative of an animal.

4. The bathroom hygiene training system as set forth in claim 1 wherein said seat sensor is proximate said seat of said toilet.

5. A bathroom hygiene training system for teaching a child proper bathroom hygiene, the training system comprising:

a toilet having a bowl, a tank and a seat;

a toilet sensing housing being removably coupled to said tank, said toilet sensing housing being generally shaped like a monkey such that said toilet sensing housing providing a pleasing character for the child to relate to, said housing having a front face, a rear face and a perimeter wall, said perimeter wall being extended between a perimeter of said front face and a perimeter of said rear face;

a toilet sound play back assembly being orientated within said toilet sensing housing, said toilet sound play back assembly having a digital playback controller and a speaker, said speaker being for playing back prerecorded messages stored by said digital playback controller upon the activation of said digital playback controller;

a seat sensor being for detecting motion, said seat sensor being coupled to said toilet sensing housing such that when said seat is raised said seat sensor is covered, said seat sensor being for sending a seat raised activation signal to said playback controller when said seat is raised;

a handle sensor being coupled to said toilet sensing housing proximate a flushing handle of said tank, said handle sensor being for detecting movement of said handle and sending a handle activation signal to said playback controller upon detecting movement of said handle;

a step stool having a platform, a handrail and a plurality of adjustable legs, a step stool sound play back assembly being orientated within said platform of said step stool, said hand rail being couple to an end of said step stool, said adjustable legs extending downward from a bottom surface of said platform;

a sensor pad being coupled to an upper surface of said platform of said step stool, said sensor pad being adapted for detecting pressure changes due to the child stepping onto said sensor pad, said sensor pad being for sending a sensor pad activation signal to said step stool play back assembly upon detecting pressure change;

a sink having a counter top, a washbasin and a pedestal;

a soap dish sensing housing being for resting upon the countertop proximate the washbasin, a soap dish sound play back assembly being orientated within said soap dish sensing housing; and a soap dish sensor being coupled to said soap dish sensing housing, said soap dish sensor being for detecting movement in an area proximate said soap dish housing and sending a soap activation signal to said soap dish sound play back assembly upon detecting movement.

* * * * *